US009115430B2

(12) United States Patent
McMullen

(10) Patent No.: US 9,115,430 B2
(45) Date of Patent: Aug. 25, 2015

(54) ANODE DEVICE AND MAINTENANCE METHOD

(76) Inventor: Alan McMullen, Marco Island, FL (US)

( * ) Notice: Subject to any disclaimer, the term of this patent is extended or adjusted under 35 U.S.C. 154(b) by 250 days.

(21) Appl. No.: 13/610,687

(22) Filed: Sep. 11, 2012

(65) Prior Publication Data

US 2014/0069803 A1 Mar. 13, 2014

(51) Int. Cl.

| | |
|---|---|
| ***C23F 13/00*** | (2006.01) |
| ***C25B 11/00*** | (2006.01) |
| ***C25B 9/00*** | (2006.01) |
| ***C23F 13/10*** | (2006.01) |
| ***C23F 13/18*** | (2006.01) |
| ***C23F 13/22*** | (2006.01) |

(52) U.S. Cl.

CPC ..... *C23F 13/10* (2013.01); *C23F 13/18* (2013.01); *C23F 13/22* (2013.01); *C23F 2213/31* (2013.01)

(58) Field of Classification Search

CPC ..... C23F 13/02; C23F 13/06; C23F 13/08; C23F 13/10; C23F 13/18; C23F 13/22; C23F 2213/32; C23F 2213/30

USPC ..... 204/196.01, 196.06, 196.3, 196.631, 204/196.37; 205/724, 740

See application file for complete search history.

(56) References Cited

U.S. PATENT DOCUMENTS

| | | | | |
|---|---|---|---|---|
| 3,753,888 | A * | 8/1973 | Alewitz | 204/196.16 |
| 3,867,274 | A * | 2/1975 | Herman | 204/196.16 |
| 4,051,007 | A * | 9/1977 | Hossle | 204/196.07 |
| 5,373,728 | A * | 12/1994 | Guentzler | 204/196.07 |
| 2005/0025608 | A1 * | 2/2005 | Fedor | 411/337 |
| 2007/0125640 | A1 * | 6/2007 | Marcelino et al. | 204/196.01 |

* cited by examiner

*Primary Examiner* — Edna Wong
*Assistant Examiner* — Alexander W Keeling
(74) *Attorney, Agent, or Firm* — Frank J. Bonini, Jr.; John F. A. Earley, III; Harding, Earley, Follme & Frailey, P.C.

(57) ABSTRACT

A method and device for facilitating maintenance of an anode of a marine engine cooling system, the device including an anode for use with an anode plug such as, for example, an anode plug that has a detachable component with a threaded end for mounting to a threaded bore of a cooling system structure, and a connector that holds the anode, the anode having an indicator for indicating a condition of the anode which is indicative of a need to replace the anode The method permits changing the anode by removing and/or reinstalling an anode while preventing or minimizing water from exiting the cooling system of the marine engine.

25 Claims, 17 Drawing Sheets

ANODE DEVICE AND MAINTENANCE METHOD

BACKGROUND OF THE INVENTION

1. Field of the Invention

The present invention relates to an apparatus and method for cooling systems of an internal combustion engine, and more particularly to an anode device and maintenance method for marine engines.

2. Brief Description of the Related Art

Many marine engines have a cooling system which involves the introduction of seawater through the heat exchanger engine or manifolds. The engine cooling system generally has one or more threaded openings that are designed to receive a sacrificial zinc anode and plug. These zinc pencils or pencil anodes, as they are often referred to, contain a zinc alloy and usually are supplied with threaded brass plugs. The threaded brass plugs are threaded externally to fit within the threaded opening of the engine cooling system port. The brass plugs also contain internal threads for threading with the zinc anode so that the zinc anode is held within the brass plug. The brass fitting with the zinc anode typically threads into a port of an engine or cooling system so that the anode comes into contact with the raw seawater passing through the system. The zinc anode has a useful life and requires replacement. The replacement of the zinc anode is done to extend the life of marine engine coolant systems, such as, engines, heat exchangers, pipes, condensers, water cooling jackets, and other components that come into contact with the seawater.

The function of the zinc anode is to reduce corrosion of other components. For example, when two different metals are in contact, electrons will flow from the more negatively charged metal (anode) to the more positive metal (cathode). For example, in cooling systems, dissimilar metals may be in contact through a fluid (e.g., seawater) which acts as an electrolyte. A current may be established which promotes galvanic corrosion. In situations where the metals (e.g., the two different metals) are to be protected from corrosion, an additional metal is introduced so it is available to serve as the anode for both of the other metals (i.e., the metals that are desired to be preserved). The zinc anode is used, and is commonly termed the sacrificial anode, because it is designed to protect the engine cooling system components from degradation due to galvanic corrosion. Providing the sacrificial zinc anode in the form of a plug which is sacrificed as an anode directs this electrolysis to a relatively inexpensive, replaceable component in order to protect the more valuable cooling system or engine components. The zinc anode degrades upon use, and is replaceable, which is much less costly than replacing other, more expensive components of the cooling system. It is possible that other types of metals may be used in alloys with, or as a substitute for zinc, but zinc is a widely used sacrificial anode.

One of the problems encountered in the replacement of the zinc anode is that the plug containing the zinc anode generally seals an access port to the flow path of the cooling system where the coolant (seawater) passes. Due to the configurations of the cooling systems, there often is seawater present in the cooling system, which emerges from the cooling system when the plug is removed. Even slowly removing the brass plug containing the zinc anode (or a spent zinc anode that is to be replaced), may result in spray or leakage of seawater out of the cooling system and onto surrounding components. The escape of seawater from the cooling system may contaminate or corrode other nearby components, such as, for example, an alternator or starter. In addition, the escaping seawater may build up in the bilge, which then often must be pumped out and rinsed with fresh water. Another problem is that the brass fitting containing the zinc may be difficult to withdraw from the port. In some cases the threads may become stuck, and attempts to remove the brass fitting and the remainder of the spent zinc anode that may be attached to the fitting, may result in pieces of the anode fragmenting off into the cooling system. In some instances, the zinc anode may fall into the engine system and block the passage of the seawater. This could cause engine overheating and potential destruction of the engine and associated components.

At times, when the maintenance of the zinc anode is not performed in a timely manner, the zinc can corrode away to the point that it cannot be removed from the plug. This requires both a new plug and new anode to be installed.

A need exists for a device and method that will facilitate maintenance and installation of a zinc anode in an economical manner without the drawbacks of the prior plugs and methods, particularly the escape of water from the cooling-system.

SUMMARY OF THE INVENTION

A method and device are provided for maintaining a marine engine, and more particularly a method and device that permits the installation, removal and replacement of an anode, such as a zinc anode, in a cooling system of a marine engine are provided.

It is an object of the present invention to provide a device that facilitates installation and replacement of an anode of a marine engine or its cooling system.

It is an object of the present invention to provide a method for replacing an anode, such as a zinc anode of a marine engine cooling system, in a manner that minimizes or prevents escape of seawater from the cooling system.

It is an object of the invention to provide a connection and disconnection mechanism that seals the cooling system environment to prevent water from exiting the cooling system environment at the location of the anode plug, during the installation, withdrawal and replacement of an anode.

It is another object of the invention to provide a method and device that excludes water from the point of attachment between the zinc anode and the plug so the zinc anode may be replaced without the need to replace the plug.

It is another object of the invention to provide an improved anode plug that minimizes or prevents the escape of fluid from a system in which the anode plug is installed.

It is another object of the invention to provide an improved anode for installation and use with an anode plug.

It is another object of the invention to provide an anode that has an indicator that indicates a condition of the anode to indicate when the anode requires replacement.

BRIEF DESCRIPTION OF THE DRAWING FIGURES

Figure 2:
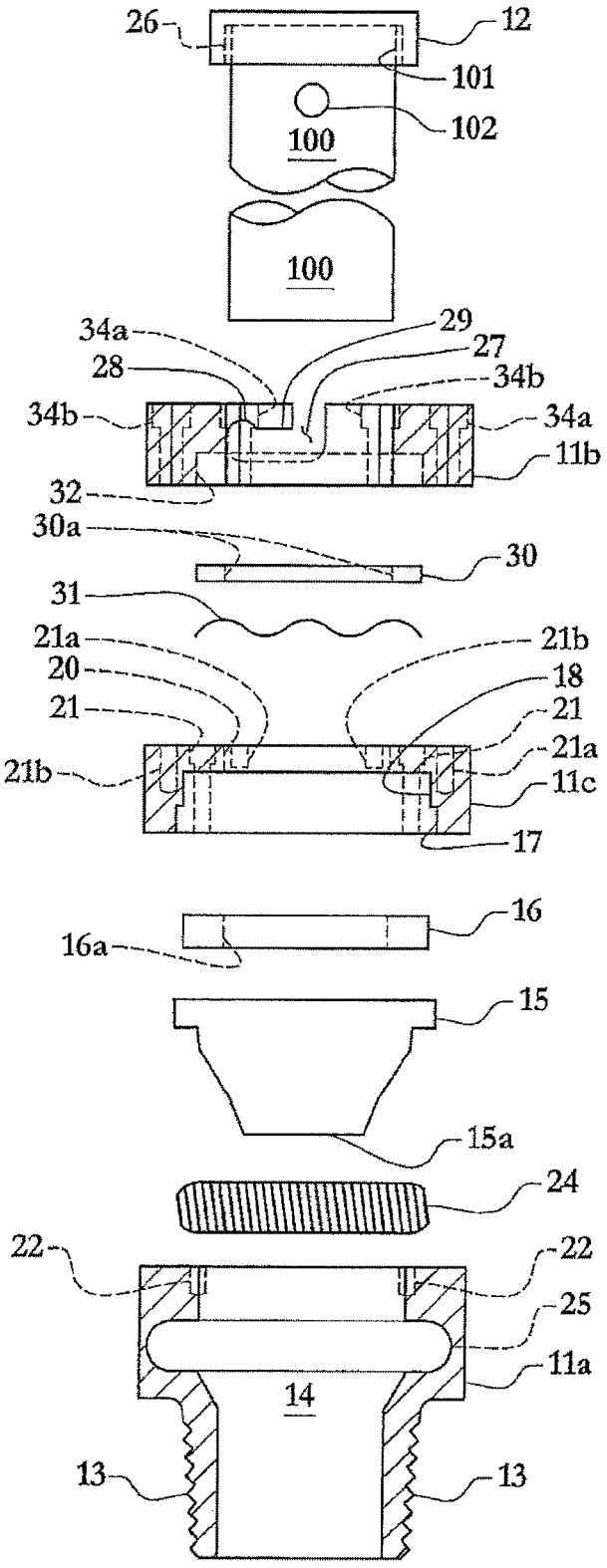
FIG. 2 is an exploded view of the device of FIG. 1, showing the components separately from a cooling structure, with the connector body portions being shown in sectional view.
Figure 2A:
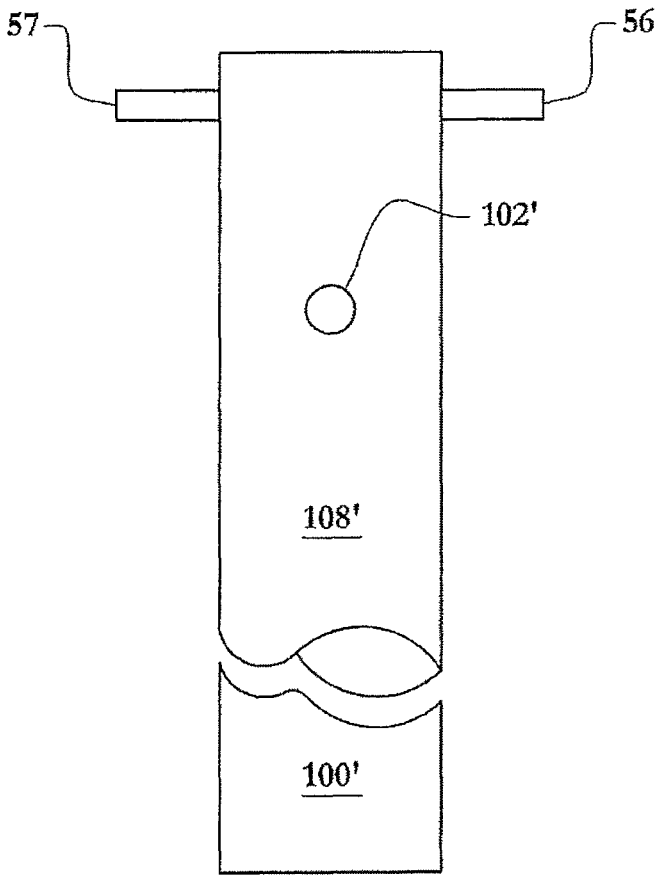

FIG. 2*a* is a front elevation view of an alternate embodiment of an anode.

Figure 1:
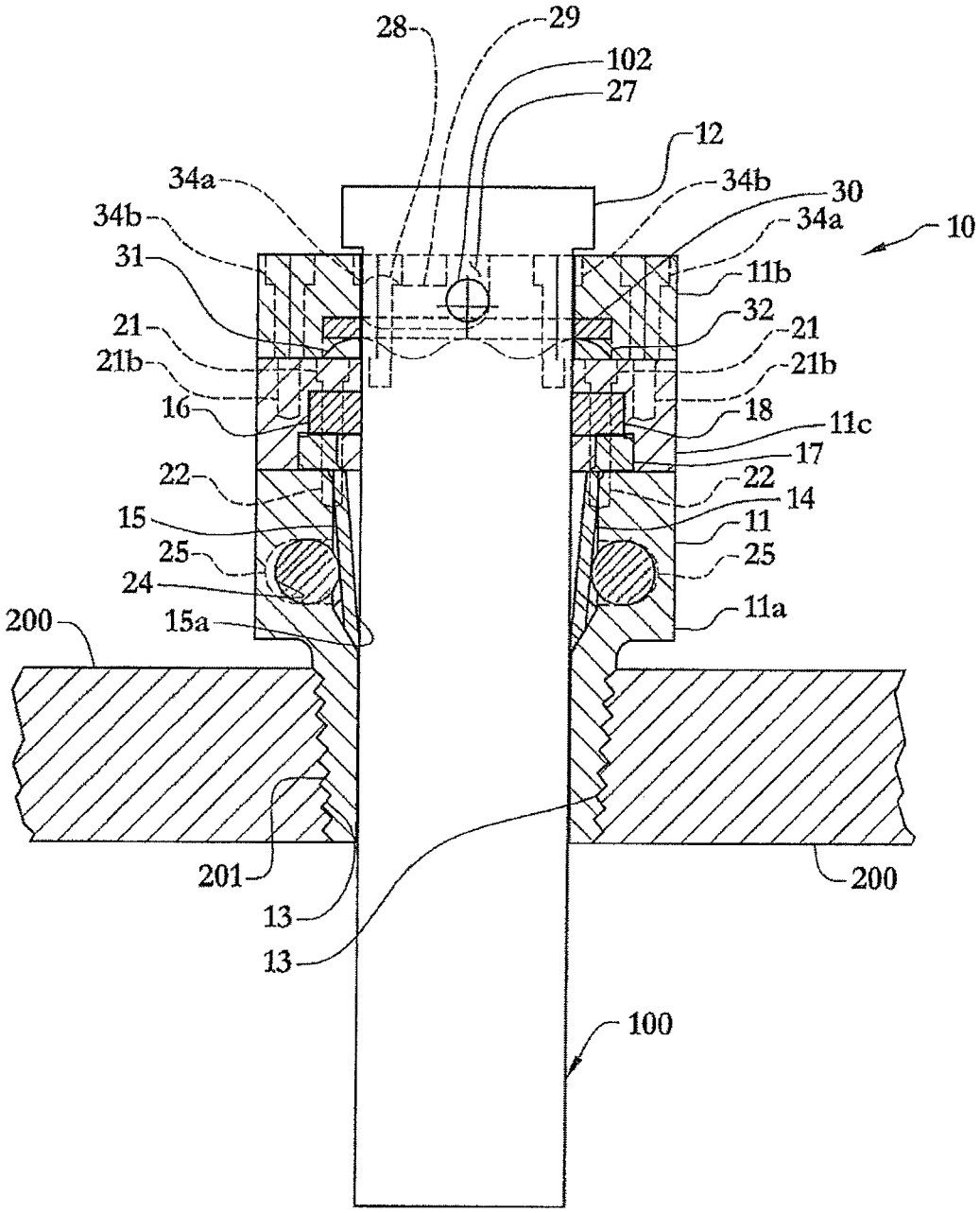
FIG. 1 is a front sectional view of an embodiment of an anode plug device according to my invention, shown with an anode installed, with the device being shown installed in a structure of a cooling system of a marine engine, the cooling system structure being partially shown, and in a sectional view.
Figure 3:
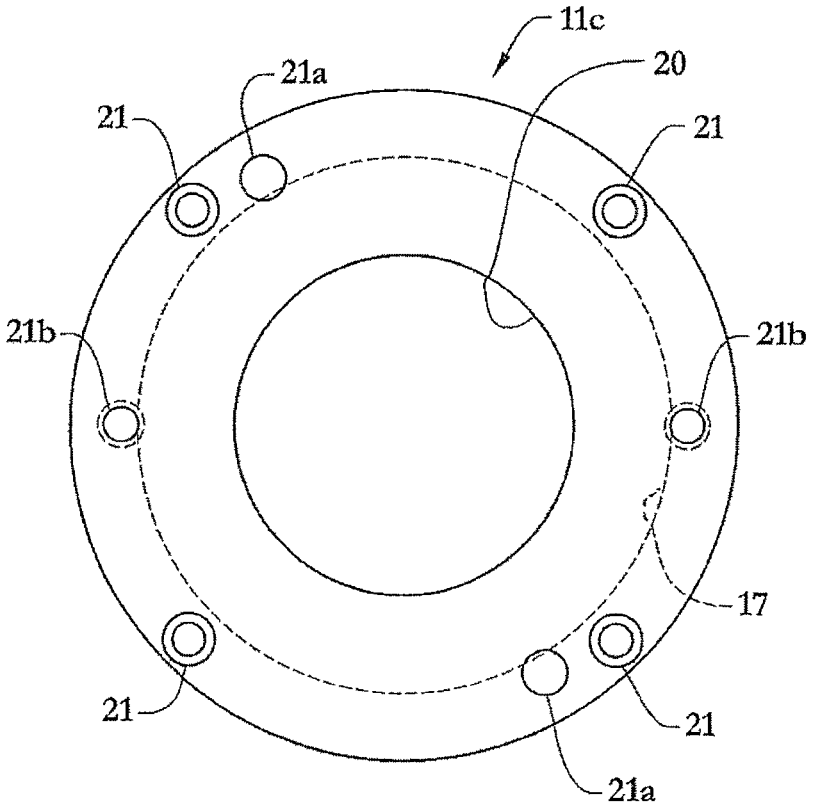

FIG. 3 is a top plan view of the connecting body portion of the device of FIG. 1.

Figure 4:
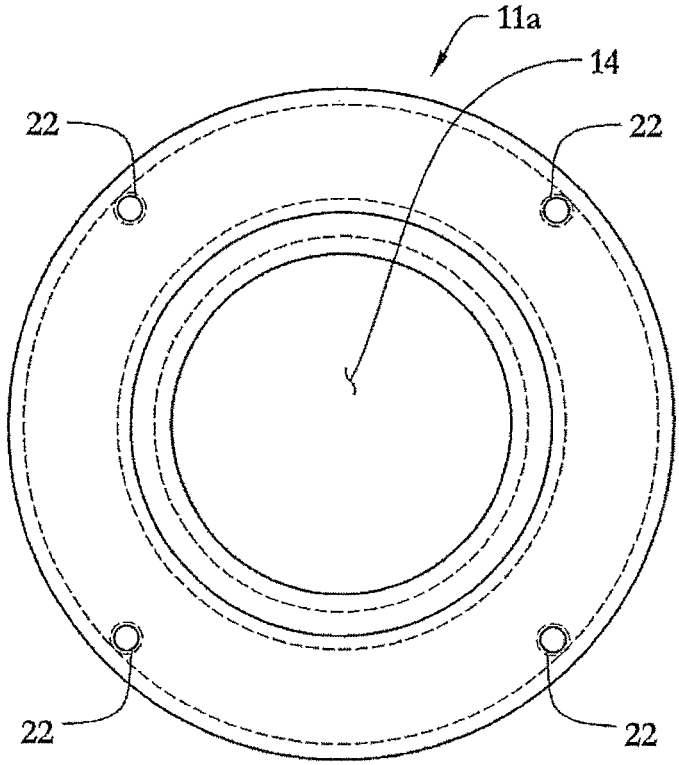

FIG. 4 is a top plan view of the lower body portion of the device of FIG. 1.

Figure 5:
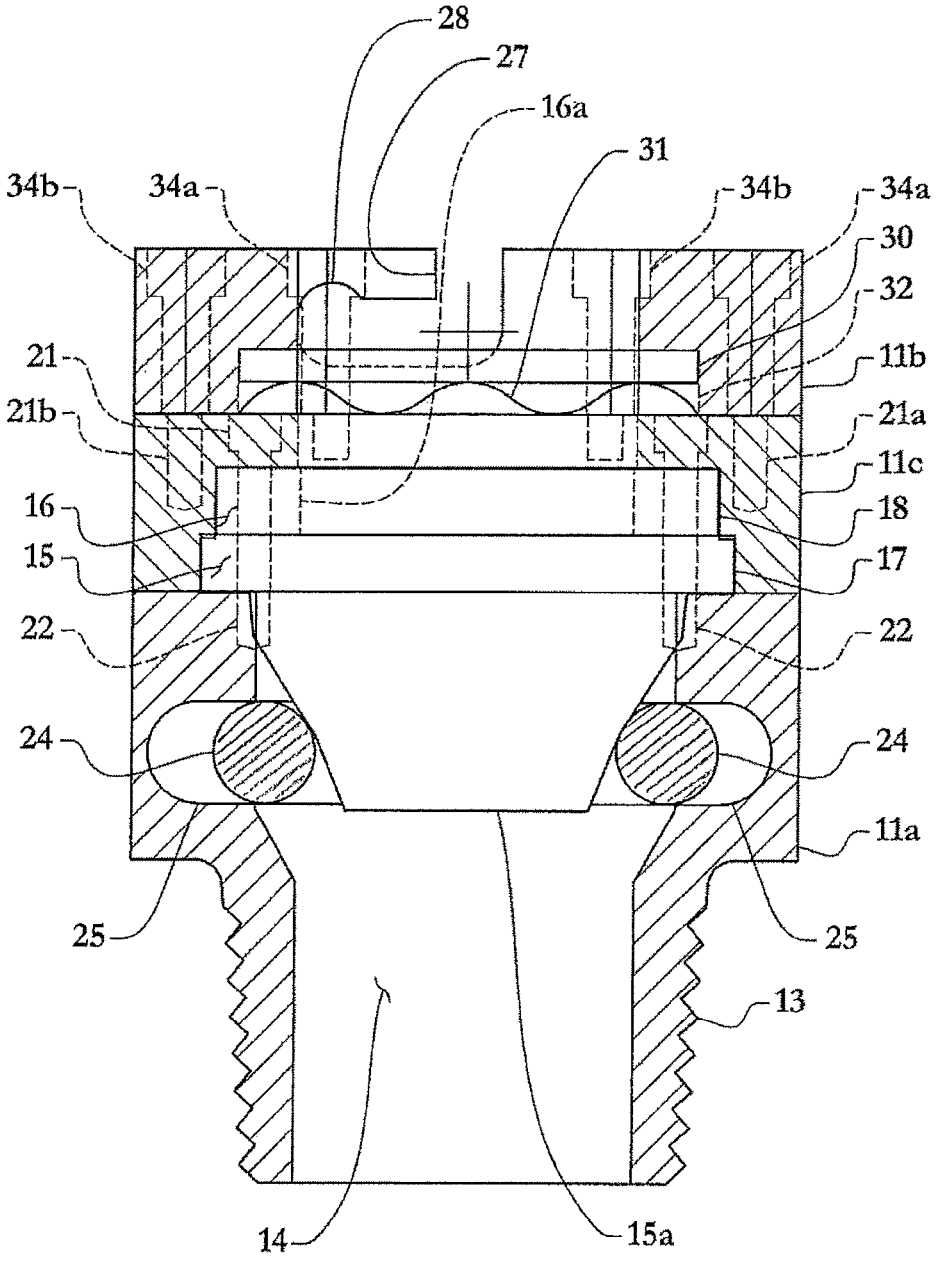

FIG. 5 is a sectional view looking at the front of the device of FIG. 1, shown without the anode.

Figure 6:
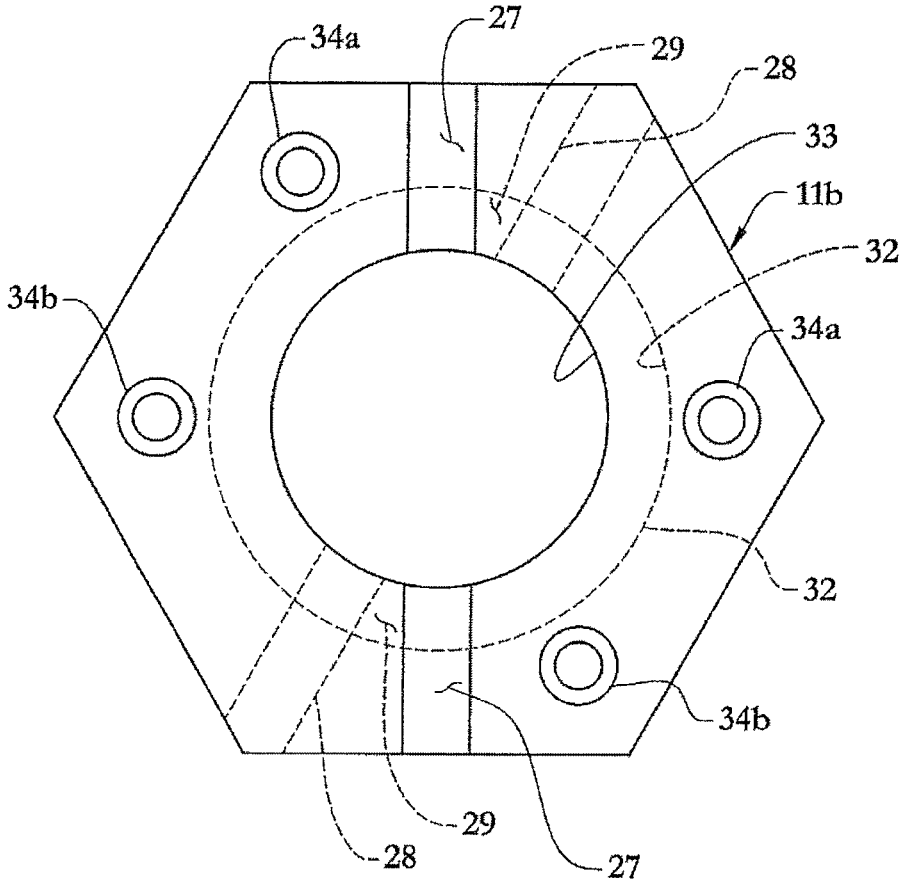

FIG. 6 is a top plan view of the upper body portion of the device of FIG. 1.

Figure 7:
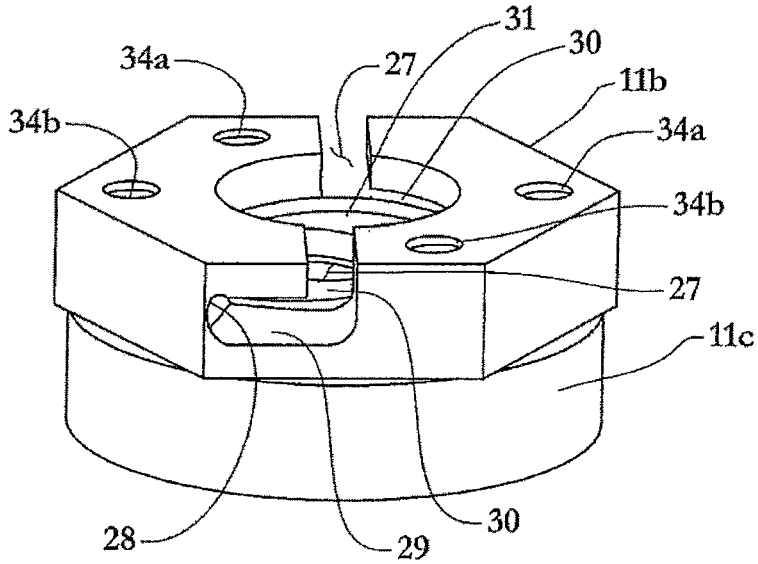

FIG. 7 is a perspective view showing the connector upper body portion and connecting portion together and separate from the other components.

Figure 8:
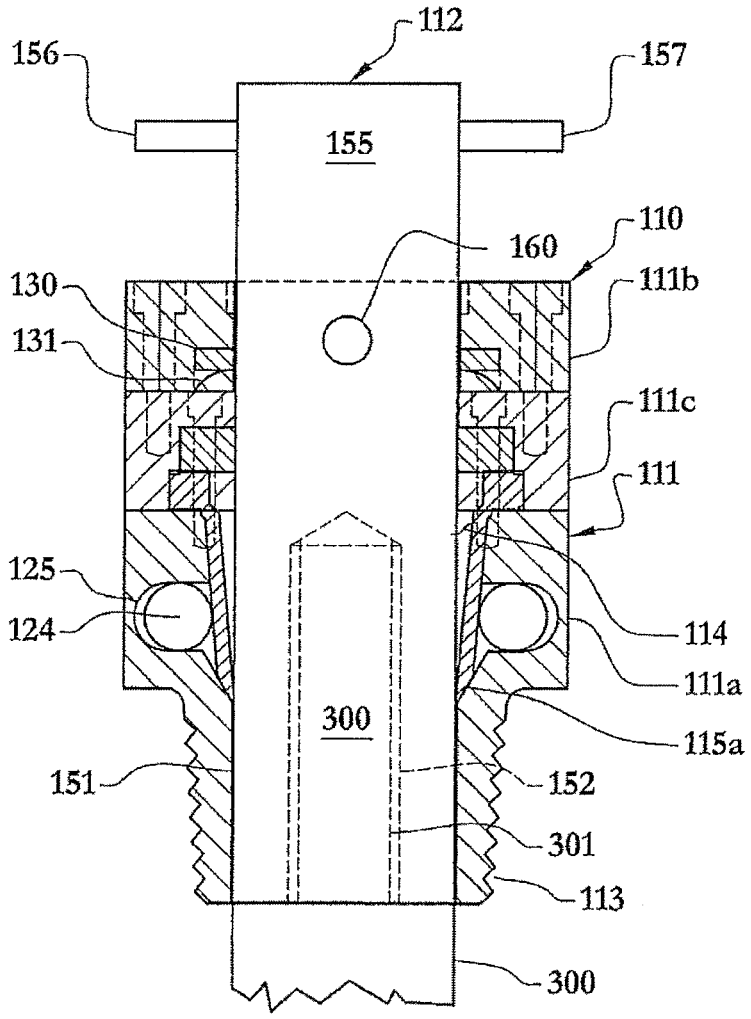

FIG. 8 is a front sectional view of an alternate embodiment of an anode plug device with an alternate anode.

Figure 9:
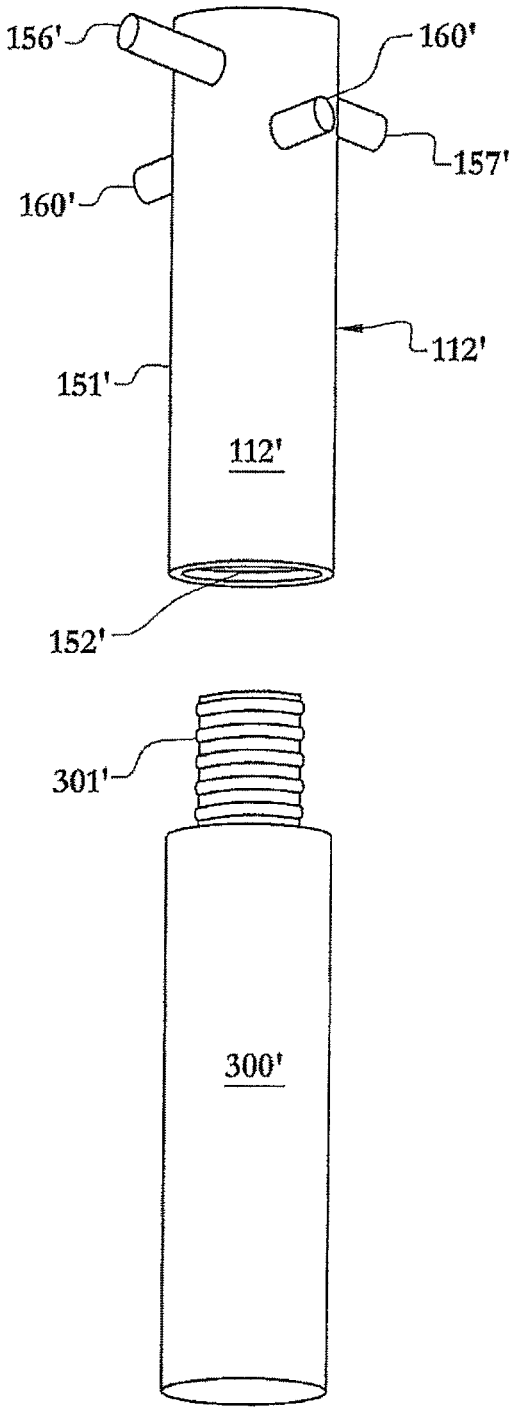

FIG. 9 is a perspective view of an alternate embodiment of an anode.

Figure 10:
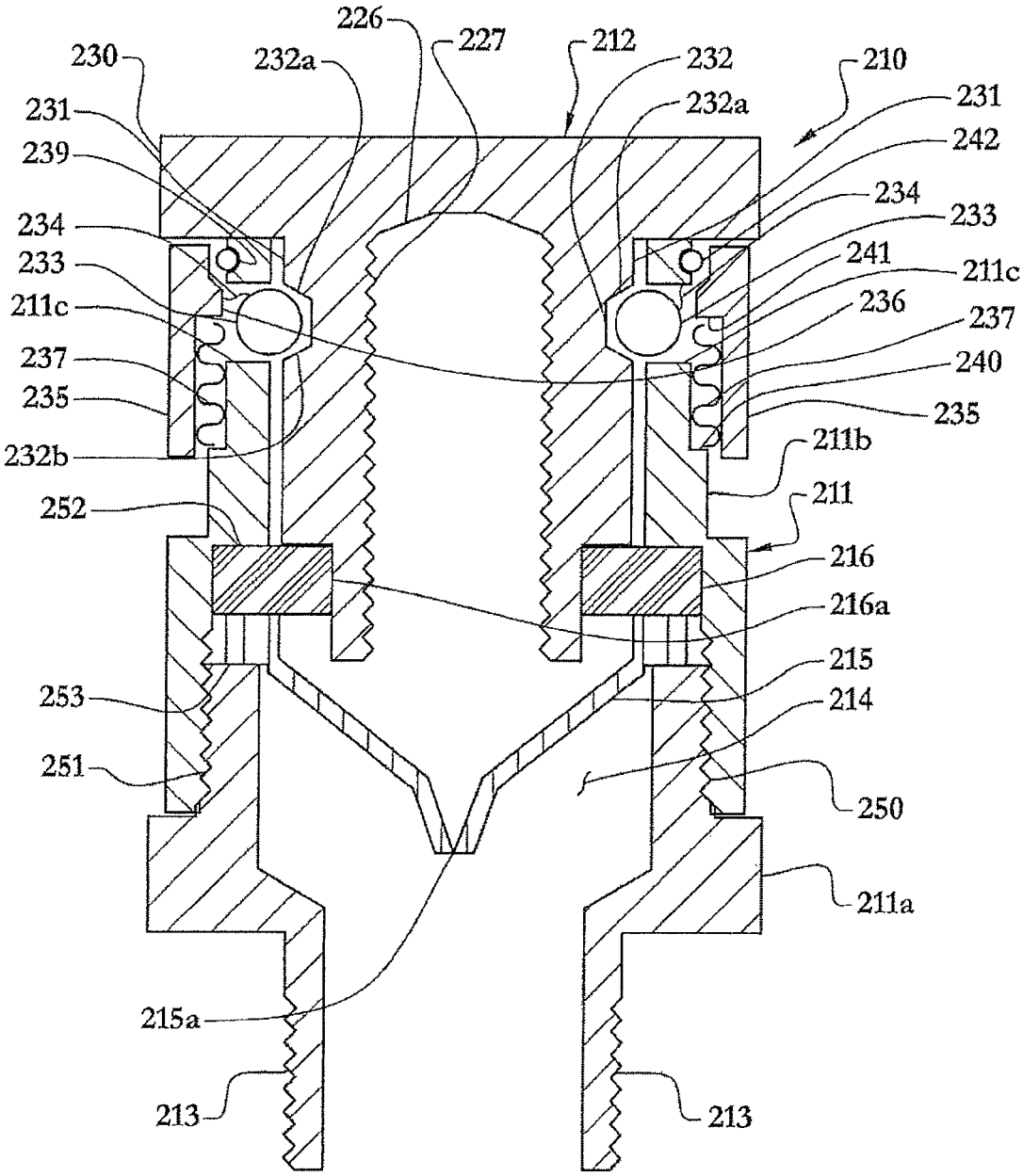

FIG. 10 is a front sectional view of another alternate embodiment of an anode plug device according to my invention.

Figure 11:
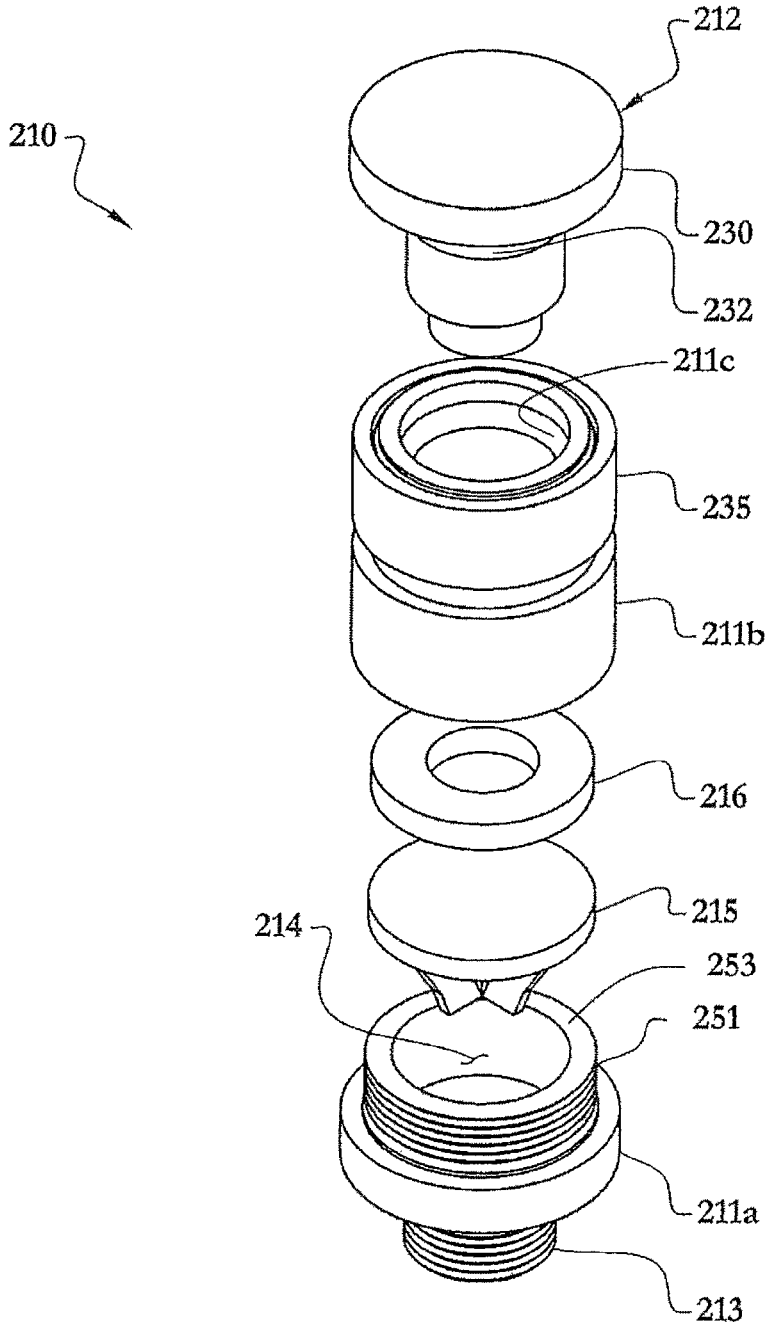

FIG. 11 is an exploded view of the anode plug device of FIG. 10, the components being shown separately from the spring and bearings.

Figure 12:
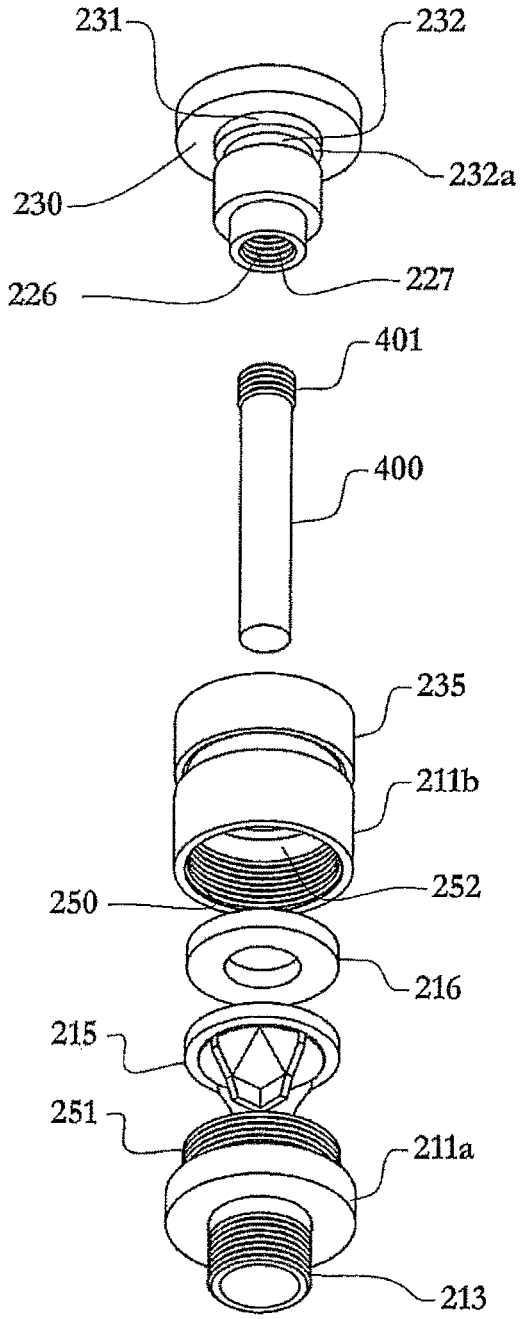

FIG. 12 is another exploded view of the anode plug device of FIG. 10, being shown with an anode.

Figure 13:
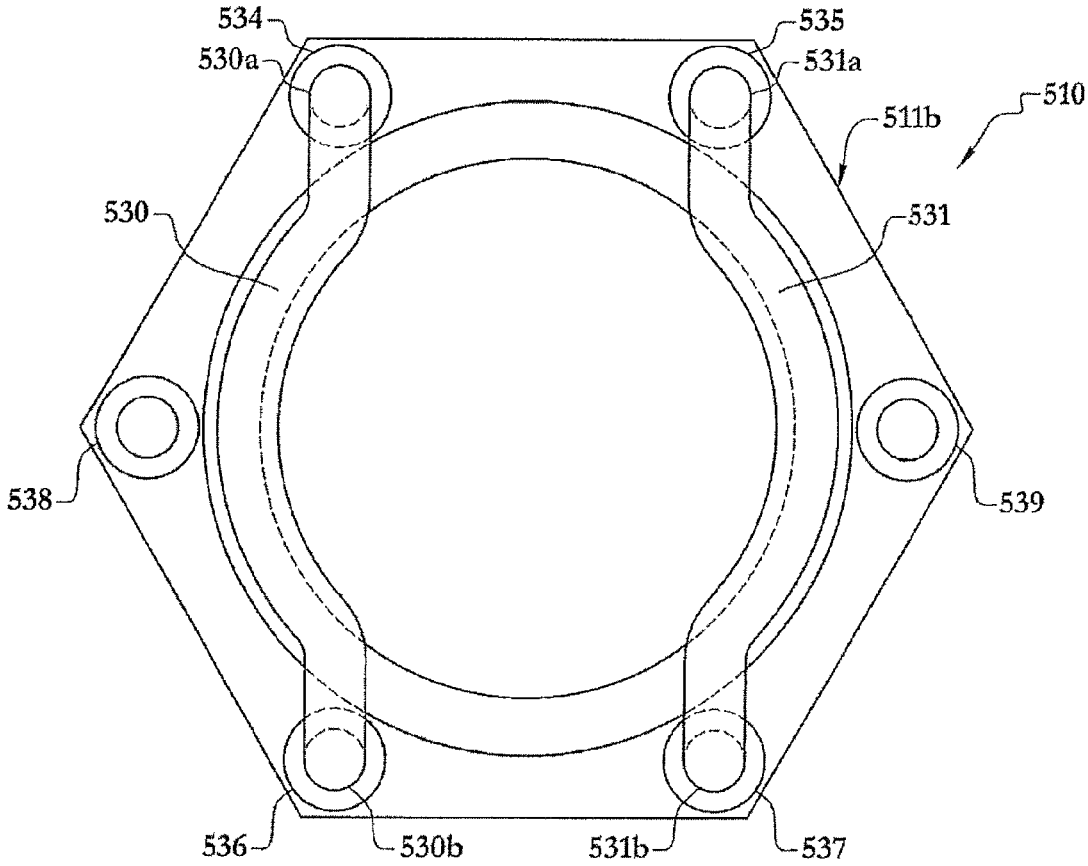

FIG. 13 is a top plan view of an alternate embodiment of an upper body portion of a connector shown with a connecting mechanism.

Figure 14:
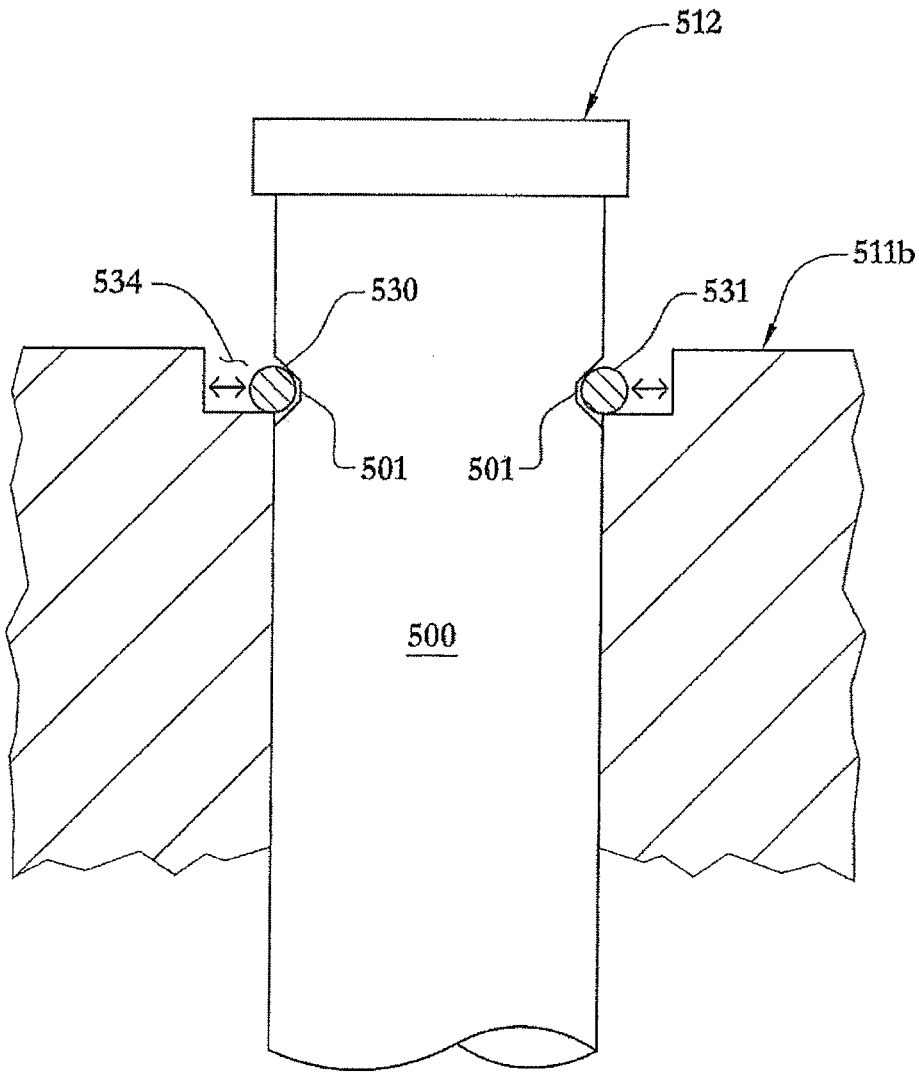

FIG. 14 is a sectional view of the upper body portion of FIG. 13 shown with an alternate embodiment of an anode.

Figure 15:
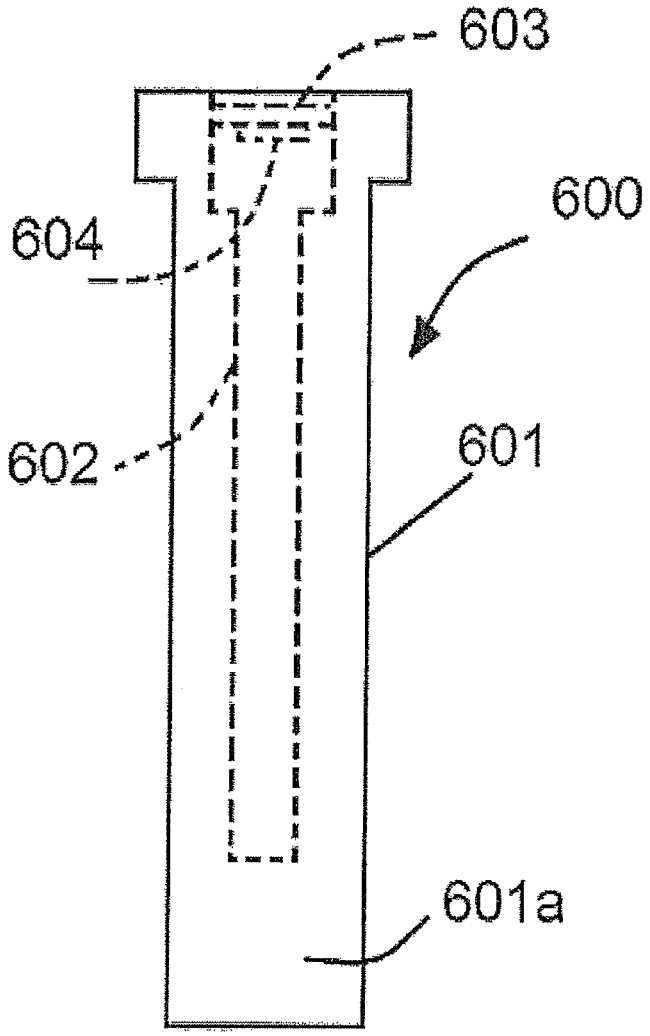

FIG. 15 is a front elevation view of an alternate embodiment of an anode.

Figure 16:
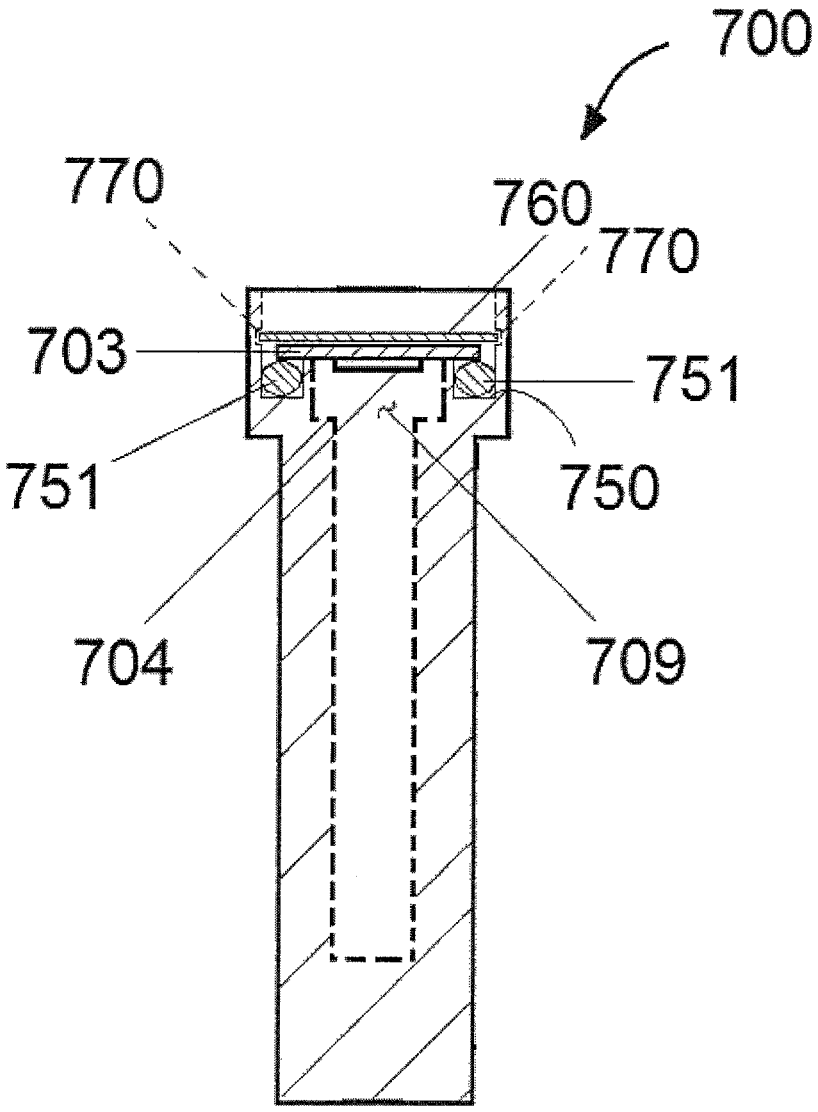

FIG. 16 is a front elevation view of another alternate embodiment of an anode.

DETAILED DESCRIPTION OF THE PREFERRED EMBODIMENTS

Referring to FIG. 1, a preferred embodiment of an anode plug device 10 is shown with an anode 100 held therein. The anode plug device 10 is shown according to a preferred embodiment having a connector 11 that has a channel therethrough. According to a preferred embodiment, the connector 11 is illustrated having a lower body portion 11*a*, an upper body portion 11*b*, and a connecting portion 11*c*. The connector 11 preferably has a threaded portion 13 that is matingly threaded for connection to a threaded bore 201 of an engine cooling system component, such as the pipe 200 (or other structure to which the device 10 is mounted). The connector 11 preferably has sealing means comprising a sealing mechanism for sealing the passage of seawater from escaping through the connector 10 when the anode 100 is removed. The sealing mechanism preferably comprises a sealing component. According to some embodiments, the sealing component may comprise a spring-loaded wafer valve. According to other embodiments, the sealing component may comprise an elastomeric seal. A preferred embodiment is illustrated, where a sealing mechanism is provided that includes at least one sealing member. According to some embodiments, a connector 11 has a chamber 14 in which a first sealing member 15 is disposed, the first sealing member 15, according to a preferred embodiment, comprises a cross-slit valve, having an opening 15*a*. As shown in FIG. 2, in the exploded view, the sealing means is shown, and, according to a preferred embodiment, a first sealing member is illustrated being configured as cross-slit valve 15. According to a preferred embodiment, the cross-slit valve 15 preferably is elastomeric. Preferably, the sealing means may include a second sealing member 16, which may be provided as an additional sealing point to further facilitate the sealing properties of the device 10. Alternately, although not shown, according to an alternate embodiment, the sealing members 15, 16 may be provided as a single member. The second sealing member 16 has an opening 16*a* therein, as shown in FIG. 2. According to a preferred embodiment, the second sealing member 16 seals against an annular flange 18 of the connecting portion 11*c*. The connecting portion 11*c* is shown in FIGS. 2 and 3 having an aperture 20 therein and bores 21 that align with bores 22 of the lower body portion 11*a*. The lower body portion bores 22 preferably are threaded to receive matingly threaded fasteners, such as bolts (not shown) that connect the connecting portion 11*e* with the lower body portion 11*b*. The connecting body portion 11*e* (FIG. 3) also has bores 21*a*, 21*b* that preferably may be threaded and align with bores 34*a*, 34*b*, respectively, of the upper body portion 11*b*. Bolts (not shown) may be installed in the bores 21*a*, 21*b* and 34*a*, 34*b* to connect the upper body portion 11*b* with the connecting body portion 11*c*. According to a preferred embodiment, a biasing mechanism is provided to bias the valve 15 to a sealing position against the body of the anode 100, and, according to some embodiments, to bias the valve 15 to seal the valve opening 15*a* closed when the anode 100 is not present in the valve opening 15*a*. According to a preferred embodiment, the biasing mechanism includes a garter spring 24, which, for example, preferably may be a coil spring tied or secured end-to-end to provide an even force around the valve 15. The garter spring 24 preferably maintains the valve 15 in sealing engagement against the anode 100 by keeping the valve 15 against the anode 100 (or, when the anode is not present within the valve opening 15*a*, closes the valve opening 15*a* by exerting a biasing force on the valve 15). An annular groove 25 preferably is disposed in the lower body portion 11*a* in which the spring 24 is disposed, and, as shown in FIG. 1, in the assembled view, the spring 24 engages the valve 15. FIG. 5 shows the device 10 with the anode 100 removed therefrom, and illustrates the biasing of the spring 24 against the valve 15 to close the valve opening 15*a*.

According to a preferred embodiment, as shown in FIG. 2, the cap member 12 is provided having a bore 26 therein which preferably is threaded with mating threads that engage the threaded end 101 of the anode 100 to hold the anode 100 in engagement with the cap member 12. Alternately, an anode that is not threaded may be turned into the threads of the cap member 12 to be releasably secured therein. Alternately, the anode may be provided without a cap member, and according to some embodiments, the anode may have a handle or gripping means to facilitate rotating the anode (see FIGS. 8 and 9). The connector 11 preferably has connecting means for providing a removable connection between the connector 11 and the anode 100. The connecting means provides a connection to secure the anode 100 on the connector 11, and permits removal of the anode 100 from the connector 11 as needed or desired to replace, install, maintain or inspect the anode 100, or to maintain the structure to which the device 10 is installed, such as, for example, a pipe 200 of an engine system.

According to a preferred embodiment, connecting means is shown comprising a connection mechanism. As shown in the exploded view of FIG. 2, according to a preferred embodiment, the anode 100 is provided having pins 102 that connect to the connector 11. The connector upper body portion 11*b* preferably has an engaging mechanism that engages the anode pins 102 to connect the anode 100 the device 10. According to a preferred embodiment, the engaging mechanism may capture the anode 100 by capturing pins 102 provided on the anode 100. According to a preferred embodiment, alternately, the anode 100 may be provided with an integral cap. The upper body portion 11*b* preferably has a bore 33 therethrough in which the anode 100 (or cap member sleeve 151 in the embodiment shown in FIG. 8) may pass through. The pins 102 engage the outer slots 27 (see FIGS. 1, 2, 5 and 6) provided in the upper body portion 11*b*. As shown in FIGS. 6 and 7, the upper body portion 11*b* has outer slots 27 and inner slots 28 provided therein for receiving the pins 102 of the anode 100. The slots 27 and 28 are connected by a channel 29, and according to a preferred embodiment, a pair of slots 27, 28 is provided on opposite sides of the upper body portion 11*b*. For example, according to the exemplary embodiment, in FIG. 1, an anode 100 is connected to a cap member 12, and the anode 100 is connected to the upper body portion 11*b* by way of the pin engagement with the slots 27, 28 and channel 29. According to one embodiment, the slots 27, 28 and channel 29 are provided at diametrically opposite sides of the upper body portion 11*b*. Preferably, the connection is made by aligning the pins 102 with the outer slots 27. The pins 102 are received in the outer slots 27, and the anode 102 is rotated to move the pins 102 along the channel 29. Preferably, the anode 102 rotation may be facilitated with downward pressure (in the direction toward the lower body portion 11*a* end) to move against resistance of a biasing mechanism that urges the pins 102 upward. When the pins 102 reach the inner slots 28, the pins 102 are cammed upwardly into the slots 28 by the action of a biasing mechanism. The biasing mechanism, according to a preferred embodiment, includes a wafer spring or wave washer 31 that preferably has an opening (see FIG. 1) to permit passage of the anode 100 therethrough. Preferably, a camming washer, such as, for example, a stainless steel washer 30 with an opening 30*a* (see FIG. 2), is disposed above the wave washer 31 and provides a camming surface for the pins 102 to travel along when the pins 102 are being rotated for installation or removal from the device 10.

A handle preferably may be provided on the anode 100 or cap 12 to provide a means for gripping the anode 100 or cap member 12 to facilitate rotation and removal of the anode 100 (and any cap thereon) from the connector 11. Referring to FIG. 2*a*, according to a preferred embodiment, an alternate anode embodiment 100' is shown having a handle that may comprise a pin, or pins, 56, 57. The pins 56, 57 may comprise a single pin that is passed through the upper portion of the anode 100' (or a cap). Similar pin handles 156, 157 are shown in FIG. 8, and pins 156', 157' are shown in FIG. 9. Referring to FIG. 2*a*, the pins 56, 57 are shown in the exemplary anode 100' and may be integrally provided with the anode 100', or, alternately, may be separately provided, and attached, for example, through a horizontal bore (not shown) of the anode 100'. The anode pins 102' also connect with the device 10 through the connection to the upper body portion 11*b*, as shown and described herein in connection with the pins 102.

Preferably, the anode pins 102 also make contact with the upper body portion 11*b* when the anode 100 is installed on the device 10, so as to maintain the anodic contact between the anode 100 and the system structure 200, which, according to ta preferred embodiment, is done by having electrical conductivity maintained between the anode 100 and upper body portion 11*b*, through the connector 11, and according to the preferred connector embodiment, by maintaining electrical conductivity between the upper, connecting and lower body portions, respectively 11*b*, 11*c*, and 11*a*. According to a preferred embodiment, the connection mechanism comprises a washer 30, such as for example a stainless steel washer, and a wave washer 31, which are disposed in a recess 32 of the of the upper body portion 11*b* of the connector 11.

According to a preferred embodiment, the anode 100 is releasably installed on the connector 11*b*. One preferred method of installing the anode 100 on the connector 11 is to position the anode pins 102 within the outer slots 27, and apply a downward pressure against the force of the wave washer 31 to lower the pins 102. The anode 100 is then rotated to move the pins 102 along the channel 29 to locate the pins 102 in the inner slots 28, whereupon release of the downward pressure releases the force applied on the wave washer 31, and the pins 102 are biased upwardly into a locking position where the pins 102 are seated within the inner slots 28. Referring to FIG. 1, a pin 102 is shown in the outer slot 27. To secure the anode 100 on the device 10, the downward pressure lowers the pin 102, whereupon it may be rotated (in the embodiment illustrated, in a clockwise direction) until it reaches the locking or inner slot 28. The other pin 102 also is lowered and rotated to the oppositely disposed slots 28. According to a preferred embodiment, the inner slots 28 are disposed higher than the channels 29 that connect each outer slot 27 with an inner slot 28. Alternately, a single channel 29 may be provided to connect the outer slots 27 and inner slots 28, or alternately, two channels 29 may be provided, each connecting an outer slot 27 with an inner slot 28.

Likewise, removal of the anode 100 from the device 10 is accomplished in a similar manner, in reverse, by depressing the top of the anode 100 or cap member 12 to lower the pins 102 from the inner slots 28, and rotating the anode 100 (or cap member 12 that carries the anode 100) counterclockwise (according to the embodiment illustrated) so as to bring the pins 102 into alignment with the outer slots 27. The anode 100 (or cap member carrying the anode 100) is then lifted to remove it from the upper body portion 11*b*. FIG. 6 shows a top view of the upper body portion 11*b* and slots 27, 28.

The device 10 preferably is used with a zinc anode 100. According to a preferred method, the device 10 may be supplied in one or more components, and may be supplied with an anode 100, such as a zinc anode, or may be supplied separately from the anodes. Although a zinc anode is described according to preferred embodiments, the anode 100 may be composed of other suitable materials, such as, for example, zinc alloys or other metals, metal compositions and alloys. According to a preferred embodiment, the anode 100 is secured to the cap member 12. Preferably, this is accomplished by threading the anode 100 onto the cap member 12 by engaging the anode threads 101 with the cap member threads 26. (See FIG. 2) If the installation involves a replacement anode, then a degraded anode which is carried on the cap member 12 is removed from the cap member 12 (preferably, by unscrewing it from the cap), and a new anode 100 installed. Alternately, although not shown, an anode may be configured having an integral cap, or alternately, in place of the cap 12, the anode may be provided with handles or pins (see, e.g., FIG. 2*a*). According to another alternate embodiment, the cap member may be configured with arms or pins that are received in slots, such as, for example, those outer slots 27 and inner slots 28 of the upper body portion 11*b*, and an anode may be secured to the cap member by screwing the threaded end of the anode to the cap member. In this alternate embodiment, the spacing and location of the slots in the alternate embodiment (like those slots 27, 28) is provided to accommodate pins of the cap. The anode 100, whether through its contacts between the pins 102 and upper body portion 11*b* or through the anode contact with the cap member 12 and the cap member contact with the upper body portion 11*b*, is in a conductive relationship with the structure to which the device 10 is attached (such as the pipe 200). Preferably, the upper body portion 11*b*, lower body portion 11*a*, and connecting portion 11*e* are conductively connected to permit electrical conductivity between the anode 100 and a structure to which the device 10 is attached.

Preferably, the device 10 is used by installing the connector 11 on the cooling system structure, such as, for example a pipe 200. According to a preferred embodiment, the connector threaded portion 13 is connected to a matingly threaded bore 201 of the structure or pipe 200. According to one option, for an initial installation, the device 10 may be installed as a unit, with the connector 11, cap member 12 and anode 100 pre-connected together. According to a preferred option, for an initial installation or for subsequent installations, the connector 11 is installed on a structure before the cap member 12 and anode 100 are installed on the connector 11. The connector 11 carries the sealing member or cross-slit valve 15 therein. The connector 11 is installed by connecting it to the threaded bore 201 of the structure 200. This may be done by rotating the connector 11 and tightening the connector mating threads 13 against the threaded bore 201. The connector 11 may remain installed on the structure 200 when subsequent replacements of the anode 100 are to be made. According to a preferred embodiment of the method, the connector 11 remains attached to the structure 200, and the cap member 12 with the anode 100 (e.g., the remaining portion of the anode 100) is removed from the device 10 by depressing the cap member 12 to lower the pins 102 in the inner slots 28, and rotating the cap member to rotate to pins 102 along the channel 29 into alignment with the outer slots 27 of the upper body portion 11*b*. The cap member 12 and any portion of the anode 100 attached thereto is then withdrawn from the connector 11 by lifting the cap member 12 and remaining anode portion (in the case where the spent anode is being removed) from the connector 11*b*. According to the embodiments where the anode 100' includes pins 56, 57 (FIG. 2*a*), the pin handles 56, 57 may be used to rotate the anode 100' to install and remove the anode from the device 10.

According to a preferred embodiment, the connector 11 remains installed on the structure (such as the pipe 200), and the cap member 12 is removed from the device 10 along with any remaining the portion of the anode 100. In many instances, when about 70% of the anode has been used, the anode should be replaced. The replacement of a worn anode before it is entirely consumed preferably is done to prevent potential corrosion of the components of the cooling system, engine or other structure to which the device 10 is attached and for which the anode 100 is used as a sacrificial anode.

The device 10 prevents or minimizes water (or other fluid) from escaping from the system, such as the pipe 200 that contains a fluid (e.g., seawater for cooling marine engines), since, as the removable components, such as, for example, the cap member 12 and anode 100, are disconnected from the connector 11, the sealing means, in particular, the first sealing member 15 covers the opening through which the anode 100 previously occupied (see FIG. 5) to block the passage of water from the structure or pipe 200. In this manner, according to a preferred embodiment, the anode 100 and cap member 12 may be removed from the connector 11. The withdrawal of the anode 100 withdrawals the anode 100 from the opening 15*a* of the cross-slit valve 15, and the cross-slit valve 15 closes to seal the opening 15*a* that the anode 100 once occupied.

The first sealing member 15 preferably, the cross-slit valve also facilitates sealing, such as when the anode 100 is consumed (by galvanic corrosion) and when the anode 100 recedes to a point above the valve 15 (relative to the direction of the cap member 12). The valve opening 15*a* will close to block passage of water. The closing of the cross-slit valve 15 is aided by the garter spring 24, which constricts the valve 15 to close the valve opening when the anode 100 is no longer present. According to a preferred embodiment, preferably, the sealing member 15 is constructed from a resilient and suitably corrosion resistant material, such as a substantially non-reactive component, like silicone, or other elastomer, so that the material may be moved aside to provide the opening for passage of the anode 100 when the anode is present. According to a preferred embodiment, a second sealing member 16 is shown above the first sealing member 15, relative to the cap member 12 of the device 10, and provides a further blockage to potential water that may escape from the cooling system (or other structure, such as the pipe 200) when the cap member 12 and anode 100 are removed for replacement of the anode 100 (or when the cap member 12 is removed to check the anode 100 wear condition). The second sealing member 16 preferably may be an elastomeric component, and more preferably may be made from a substantially non-reactive component, such as silicone. According to one embodiment, the second sealing member 16 preferably has at least one opening 16*a* (see FIG. 2) to permit the anode 100 to pass through. Alternately, the second sealing member 16 may be flexible so as to recede to close or substantially close the opening when the anode 100 is not present. For example, according to one embodiment, when the anode 100 is withdrawn from the connector 11, the second sealing member 16 constricts against the anode 100 as the anode 100 is being withdrawn. This provides a secondary sealing (when used in an embodiment with the first sealing member 15). According to some embodiments, the second sealing member 16 may constrict to close the opening 16*a*, when the anode 100 is withdrawn from opening 16*a*.

The cap member 12 may be removed from the connector 11, and a new anode 100 installed to replace the spent anode. Preferably, the worn remainder of the anode 100 is removed from the cap member 12, and a new anode 100 installed (by screwing the threads 101 of a new anode to the threads 26 of the cap member 12). Where a cap member is integral with an anode, or is not provided, the anode may be replaced with an anode having an integral cap or no cap (see FIG. 2*a*).

The cap member 12 and anode 100 preferably are installed on the connector 11 by inserting the leading end of the anode 100 through the sealing means or sealing component, such as the second sealing member 16 and first sealing member 15. Preferably, the first sealing member 15 seals around the anode 100 to block water from passing through the device 10 (e.g., from the structure out through the device 10).

According to a preferred embodiment, the device 10 is constructed having means for connecting the device 10 to a structure, such as, for example, a structure that may be an engine or a cooling system component of an engine. The means for connecting the device to a structure is illustrated, according to a preferred embodiment, comprising a connector 11. The device 10 preferably includes means for removably coupling an anode with the means for connecting the device to a structure. The means for removably coupling an anode with the means for connecting the device to a structure is shown, according to a preferred embodiment, comprising a connecting mechanism that removably connects the anode 100 with the connector 11. The means for removably coupling the anode with the means for connecting the device to a structure preferably comprises pins 102 that are received in outer slots 27 on the connector 11, which are rotated through a channel 29 to inner grooves 28, where the pins 102 are retained by the biasing force of a retaining member. The retaining member, according to preferred embodiments, may be a wave washer, and may include a camming surface such as a washer disposed on the wave washer. Means for holding an anode 100, according to a preferred embodiment, preferably is provided to hold the anode 100 to the cap member 12, and, in a preferred embodiment, is shown comprising threads 26 provided on the cap member 12 into which matingly associated threads 101 of an anode 100 may engage. Optionally, an alternate configuration may be used where pins are provided on the cap member. The device 10 preferably includes sealing means for sealing the structure environment so as to minimize or prevent escape of fluid from the structure to which the device 10 is attached. Preferably, the sealing means seals against the anode 100 so as to prevent escape or leakage of fluid from the engine or structure compartment that contains the fluid into the area where the anode 100 is connected to or held by the device 10. According to a preferred embodiment, the sealing means is shown comprising a seal, and, according to one preferred embodiment, the sealing means comprises, a cross-slit valve or seal 15. In a preferred arrangement, the anode 100 passes through the cross-slit valve 15 when the anode 100 is installed. According to one preferred embodiment, a constricting member constricts the valve 15 against the anode 100, or, when the anode 100 is not present, to a closed position to close the valve opening 15*a*. According to a preferred embodiment, the connecting member may comprise a garter spring 24. Preferably, the cap member 12 holds the anode 100.

Although the device 10 and method have been described, the cap member 12 (when used) preferably is connected to the connector 11 with the anode 100 already installed in place on the cap member 12. The anode 100 and cap member 12 may be connected together and then installed on the connector 11 which already has been installed on the pipe 200. According to an alternate method, when no fluid is present in the structure, as in an initial installation or dry installation, the cap member 12 and anode 100 may be installed on the connector 11, and the device 10, with the cap member 12, anode 100 and connector 11 connected together (with the cap member 12 and anode 100), may be installed on the structure, such as, for example the pipe 200, by securing the threads 13 of the connector 11 to the threaded bore 201 of the structure 200. Although a single bore 201 is shown in the structure, there may be a plurality of bores on the cooling system components, and a device 10 may be installed in each bore. Although the structure to which the device 10 is installed is illustrated as a pipe 200, it is understood that the structure to which the device 10 may be attached may comprise components other than a pipe 200, such as, for example, cooling system manifolds or other structures. In addition, the devices shown and described herein may be constructed in different sizes, and with different sized components, in order to accommodate different size bores and openings in structures to which the devices are attached. The device 10, and in particular, the connector 11, may be comprised of a conductive material that has resistance to corrosion. One example of a material from which the connector may be constructed is brass. Other examples of material from which the connector may be constructed is metal and metal alloys, including stainless steel, or other materials coated to provide suitable conductivity between the anode and structure. The device 10 may be constructed with different size components in order to be used with different sized anodes.

Referring to FIG. 8, an alternate embodiment of an anode plug device 110 is shown having a connector 111 with a channel therethrough, the connector 111, according to a preferred embodiment, having a lower body portion 111*a*, an upper body portion 111*b*, and a connecting portion 111*e*. The connector 111 preferably has a threaded portion 113 that is matingly threaded for connection to a threaded bore, such as the bore 201 of an engine cooling system component or pipe 200 (shown in FIG. 1). The connector 111 has a chamber 114 in which a first sealing member 115 is disposed, the first sealing member 115, as shown and discussed herein in connection with the embodiment shown in FIGS. 1-7, may comprise a cross-slit valve, having an opening 115*a*. A second sealing member 116 is provided above the first sealing member 115. Preferably, the cap member 112 has a sleeve 151 with a threaded bore 152 for connecting with a threaded shaft 301 of a matingly threaded anode 300. A cap member 112 (which is an optional member) is shown according to a preferred configuration constructed as a post 155 with arms 156, 157 extending outwardly from the post 155 to provide a handle for gripping and facilitating rotating of the cap member 112 and anode 300 attached thereto. The installation, maintenance and removal and replacement of the anode 300 may be done as shown and described herein in connection with the device 10, except that the cap member 112 is released and removed from the connector 111, and the anode 300 (or portion of it that remains) is unscrewed from the cap member sleeve 151, and a new anode 300 is installed on the sleeve 151. The withdrawal of the sleeve 151 from the channel 114 (when the cap member 112 is released from the device 110 and withdrawn), releases the pressure on the valve 115 and spring 124, and the spring 124 bias facilitates closing of the valve opening 115*a*. According to a preferred embodiment, the cap member 112 is secured on the connector 111 with suitable connecting means, such as, for example, the pin and slot arrangement shown and described in connection with the device 10 of FIGS. 1-7. Preferably, the cap member 112 has pins 160 that are disposed on the upper end of the sleeve 151, preferably, on opposite sides thereof, for receipt into slots and channels, such as the slots 27, 28 and channels 29 shown and described herein in connection with the device 10 of FIGS. 1-7. Preferably, the upper body portion 111*b* includes the slots 27, 28, and channels 29, as shown and described herein in connection with the embodiment of FIGS. 1-7. The pins 160 facilitate securing of the cap member 112 (when used) and anode 300 attached thereto onto the connector 111, and releasing of the cap member 112 and anode 300 from the connector 111. Installation of the device 110 to a structure may be carried out as shown and described in connection with the device 10 (which is shown installed on a structure 200).

FIG. 9 illustrates an alternate embodiment of a cap member 112' having a sleeve 151' and being constructed for use with an anode 300', which has pins 160' for facilitating a connection with a connector, such as, for example, the connector 11 or 111. The cap member 112' preferably has a handle formed from two upper pins 156', 157'. The cap member sleeve 151' preferably has a mechanism for connecting an anode 300', which according to a preferred embodiment, the mechanism is shown including a threaded bore 152' which may receive the threads 301' of the anode 300'.

Referring to FIGS. 10-12, an alternate embodiment of an anode plug device 210 is shown (with an anode 400 shown in FIG. 12). The anode plug device 210 has a connector 211 and a cap member 212. The connector 211 is illustrated having a lower body portion 211*a* and an upper body portion 211*b*. The connector 211 preferably has a threaded portion 213 that is matingly threaded for connection to a threaded bore 201 of an engine cooling system component, such as the pipe 200 (or other structure to which the device 10 is mounted as shown in FIG. 1). The connector 211 has a chamber 214 in which sealing means comprising a first sealing member 215 is disposed, the first sealing member 215, according to a preferred embodiment, comprising a cross-slit valve, having an opening 215*a*. As shown in FIGS. 11 and 12, in the exploded views, the first sealing member is illustrated being configured as a cross-slit valve 215, and preferably, the sealing means may further include a second sealing member 216. As discussed herein, alternately, the sealing members 215, 216 may be provided as a single member. The second sealing member 216 has an opening 216*a* therein. According to a preferred embodiment, the second sealing member 216 seals against the flange of the removable cap member 212. According to the preferred embodiment, the upper body portion 211*b* has threads 250 that connect with threads 251 of the lower body portion 211*a* to secure the upper body portion 211*b* to the lower body portion 211*a*. The upper body portion retaining flange 252 holds the sealing members 215, 216 against the upper ridge 253 of the lower body portion 211*a*.

The cap member 212 preferably has a bore 226 therein which preferably is threaded with mating threads 227 that engage the threaded end 401 of the anode 400 (FIG. 12) to hold the anode 400 in engagement with the cap member 212. The anode 400 may be pre-threaded, or alternately, the anode threads 401 may be provided by turning an unthreaded anode into the threaded bore 226 of the cap member 212. Alternate embodiments may be provided where the cap member 212 is not used.

The connector 211 preferably has a connecting means for providing a removable connection between the connector 211 and the cap member 212. The connecting means provides a connection to secure the cap member 212 on the connector 211 and permits removal of the cap member 212 from the connector 211 as needed or desired to replace, install, maintain or inspect the anode 400, or maintain the structure to which the device 210 is installed, such as, for example, a pipe 200 of the engine system (FIG. 1).

According to the embodiment illustrated in FIGS. 10-12, the connecting means is shown comprising a press-fit connection mechanism. A preferred embodiment of the press-fit connection mechanism comprises a plurality of bearings 233 which are disposed in the side wall 211*c* of the upper body portion 211*b* of the connector 211. The bearings 233 are shown disposed in a location adjacent the side wall 231 of the cap member 212, and preferably, the bearings 233 are located so that the annular groove 232, which, in the preferred embodiment has camming edges 232*a*, 232*b*, engages the bearings 233 to move the bearings 233 into engagement with the collar 235. The bearings 233 are provided to capture the cap member 212 to make a releasable connection between the cap member 212 and the connector 211, so that the cap member 212 is held on the connector 211. According to a preferred embodiment, the side wall 211*e* of the connector upper body portion 211*b* preferably has a plurality of bores 234 disposed therein. The bores 234 preferably are disposed in a circumferential arrangement, and preferably are spaced apart. The bores 234 are sized to accommodate the bearings 233. As shown in FIG. 10, the bearings 233 occupy the bores 234, and a bearing 233 moves within a bore 234 to provide the releasing and securing of the cap member 212 and connector 211. The annular collar 235 provided on the connector upper body portion 211*b* preferably includes an annular ridge 236 disposed for engagement with the bearings 233 when the cap member 212 is removed or installed on the connector 211. A spring 237 is provided to bias the collar in an upward direction. The spring 237 according to a preferred embodiment, is disposed on an annular ridge 240 of the first connector 211 upper body portion 211*b*, and located between the lower wall 241 of the collar annular ridge 236. The spring 237 preferably is annularly disposed about the upper body portion 211*b*. According to a preferred configuration, the collar 235 is biased by the spring 237 in a direction toward the head 230 of the cap member 212. Retaining means, such as, for example, the ring 242 shown disposed in an outer annular groove 239 of the collar 235, is provided to retain the collar 235 on the connector 211 when the cap member 212 is removed from the connector 211. The ring 242 provides a stop for the collar annular flange 236, and prevents further upward movement of the collar 235 beyond the connector upper body portion 211*b*.

The device 210 preferably is used with a zinc anode 400. According to a preferred method, the device 210 may be supplied in one or more components, and may be supplied with an anode, such as a zinc anode, or may be supplied separately from the anodes. According to a preferred embodiment, the anode 400 is secured to the cap member 212. Preferably, this is accomplished by threading the anode 400 onto the cap member 212 by engaging the anode threads 401 with the cap member threads 227. If the installation involves a replacement, then a degraded anode which is carried in the cap member 212 is removed from the cap member 212 (preferably, by unscrewing it), and a new anode installed.

The connector 211 may be installed on a structure, such as, for example a pipe 200, as is shown and described herein in connection with the embodiments illustrated in FIGS. 1-9.

Referring to FIGS. 13-14, an alternate embodiment of a connection mechanism 510 for connecting the anode on the device is illustrated with an upper body portion 511*b* having a connector comprising clips 530, 531. The clips 530, 531 preferably are constructed from a resilient material. According to one preferred embodiment, the clips are constructed from spring steel or other suitable wire. The wire clips 530, 531 are shown attached to the upper body portion 511*b* at their ends 530*a*, 530*b*, and 531*a*, 531*b*. One preferred attachment mechanism is shown comprising bores 534, 535, 536, 537, into which the ends of the wire clips 530*a*, 530*b*, and 531*a*, 531*b*, respectively, are inserted and held. Although not shown, the ends of the wire clips 530*a*, 530*b*, and 531*a*, 531*b* may be secured to the upper body portion by pins, welds, screws or other suitable means. According to some embodiments, the wire clip ends 530*a*, 530*b*, and 531*a*, 531*b* are secured by a friction fit in the respective bores 534, 535, 536, 537. The upper body portion 511*b* or the depth of the bores 534, 535, 536, 537 may be sufficient to secure the wire ends 530*a*, 530*b*, and 531*a*, 531*b*, and alternately, the depth of the bores may be sufficient to hold screws to connect the upper body portion 511*b* with another element of the connector, such as, for example the middle body portion (see 11*c* of FIGS. 1-5). According to one embodiment, bores 538, 539 may be provided in the upper body portion 511 so that screws may be used to connect the upper body portion 511*b* to another component of the connector, such as, for example, the connecting portion 11*c*. The upper body portion 511*b* may be used in place of the upper body portion 11*b*, and may be connected with the connecting portion 11*e*, and connected together with the lower body portion 11*a*. The bores 538, 539, and the bores, 534, 535, 536, 537 may receive fasteners, such as, for example screws, to connect with the connecting portion 11*c*. Alternate arrangements of the bores, or additional bores, may be provided in the components as required for alignment or connection.

As shown in FIGS. 13 and 14, the anode 500 has a groove 501 around its circumference, and when the anode 500 engages the clips 530, 531, the clips 530, 531 separate relative to one another and spring outward, and, as the anode 500 is lowered in the device, when the groove 501 is aligned with the wire clips 530, 531, the clips 530, 531 spring inwardly to engage the anode groove 501. The anode 500 thereby is held on the connector (such as for example, the connector 10 shown and described herein, but fitted with the upper body portion 511*b*). Removal of the anode 500 is accomplished by raising the anode 500 from the connector and disengaging the groove 501 from the wire clips 530, 531. The wire clips 530, 531 are moved outwardly from the groove 501 by lifting the anode 500, and the anode 500 is removed by lifting it out of the device. According to a preferred embodiment, the groove 501 preferably is an annular groove. As illustrated in FIGS. 13 and 14, according to one preferred embodiment, the groove 501 may have a first wall that is substantially vertical, such as, for example, wall 501*a* in the embodiment illustrated in FIGS. 13 and 14, and one or more walls that are angular in relation to the vertical wall 501*a*, such as, for example, the two angular walls 501*b* and 501*c*. According to an alternate embodiment (not shown) the anode groove may be non-continuous, and, according to another alternate embodiment, anode embodiments may be provided with a camming surface leading to the groove.

The anode 500 (as with other anodes shown and described herein) may have a feature to facilitate grasping and pulling, such as, for example, a pull or D-ring, a head, pins or the cap 512, illustrated in FIGS. 13-14, including any of those features as shown and described herein, or any other suitable handle or gripping member. Alternately, the anode 500 may be cylindrical (or provided without a pull) and a tool (such as, pliers, etc.) may be to remove the anode. The wire clips 530, 531, although shown and described in connection with the embodiment illustrated in FIGS. 13-14, may be utilized in conjunction with the other connectors disclosed and shown herein to removably retain the anode on a connector.

An alternate embodiment of an anode 600 is shown in FIG. 15 having a body 601 with a bore 602 provided therein. The bore 602, as shown according to a preferred embodiment, is disposed within the body 601, and the body 601 has a lower portion 601*a* provided below the bore 602. The anode bore includes a cover 603 provided at the top of the anode 600. The cover 603 may be constructed from any suitable material, and, according to a preferred embodiment, may be made from, glass, crystal or plastic, such as an acrylic. According to one preferred embodiment, the cover 603 is composed of a mineral crystal. Preferably, the cover is clear to permit viewing, and an indicator means for indicating a condition is provided so that when water reaches an indicator, the indicator provides a detectible response. According to a preferred embodiment the detectible response involves the indicator exhibiting a visual change. According to a preferred embodiment, the indicator means for indicating a condition is shown comprising a water detection pad 604 is provided at the top of the bore 602 and preferably within the bore 602. The indicator detection pad 604 may be attached to the preferred clear cover 603 and preferably is visible and can be viewed through the cover 603. The lower body portion 601*a* may be eroded or consumed during use of the anode 600 in customary operating conditions within the environments in which the anode 600 may be used, such as, for example, marine engine cooling systems and other applications where anode plugs and/or anodes are employed. The anode 600 preferably is utilized as a sacrificial anode, and when the lower portion 601*a* is consumed, the lower end of the bore 602 is exposed and the bore 602 communicates with liquid or fluid of the cooling system environment. The liquid or fluid travels through the bore 602 and reaches the indicator detection pad 604. The detection pad 604, which is a commercially available component, changes color when water reaches it, and therefore, the color change may be observable through the window or cover 603. Accordingly, when the color change is observed, then the anode 600 may be replaced with another anode 600. The anode 600 may be used with the connectors shown and described herein. The cover 603 may be attached to the anode body 601 with the use of any suitable connecting mechanism, and, for example, preferably, is sealed. An adhesive may be used to secure the cover 603 to the anode body 601. Alternately, while not shown, according to some preferred embodiments, the cover 603 may be secured in a groove or channel, and/or a sealant, o-ring or gasket may be used to prevent or minimize water from passing from the bore 602 or cover 603 outside of the anode 600. Referring to FIG. 16, another alternate embodiment of an anode 700 is constructed like the anode 600, with an indicator means including an indicator 704 (which may be the detection pad 604). The anode 700 is shown having a lower channel or annular groove 750, an o-ring 751 disposed in the lower groove 750, a cover 703 disposed to seal against the o-ring 751, and a retainer clip or ring 760. The O-ring preferably is made from any suitable material, including an elastomeric material. The cover 703, according to a preferred embodiment, may be any suitable cover, including a watch crystal, and the indicator 704, which may be a detection pad (like the pad 604), is adhered on the inside of the crystal cover 703. Preferably, the retainer clip or ring 760 is seated in an upper groove 770 and holds the crystal cover 703 in place against the o-ring 751 to prevent water from leaking out from the opening 709 covered with the crystal cover 703. Preferably, the covers or portions of the covers are clear to provide viewing of the indicator. The opening 709 communicates with the anode body channel or bore of the anode body (like the bore 602 described above in connection with the anode 600). The bore of the anode 700 is shown enclosed and is bordered by at least a portion of the anode body (like the lower body portion 601*a* of anode 600). The body bore or body channel has the top opening 709 covered with the cover 703 to provide a window through which the indicator is viewable. The cover 703 seals the first opening 709 of the channel or bore and the lower body portion of the anode that borders the body channel or bore encloses the lower or second opening of the body bore or channel, to close the lower opening of the bore when the anode lower body portion is present, and to provide an opening into the body channel or bore when the lower portion is not present so as to permit fluid communication into the body bore or channel. When at least a portion of the anode body that borders the body bore or channel is eroded (e.g., by galvanic corrosion), then the body bore or channel is provided with an opening for communicating with the cooling fluid in the structure on which the anode plug and anode are installed.

These and other advantages may be obtained through the use of the inventive apparatus and methods disclosed herein. While the invention has been described with reference to specific embodiments, the description is illustrative and is not to be construed as limiting the scope of the invention. For example, although the anode plug devices 10, 110, 210, 510 are described in connection with a marine engine, the anode plug devices may be used for applications requiring anodic contact where an anode must be maintained or replaced, such as, for example, pipelines, storage tanks, and other applications. In addition, although not shown in FIGS. 1, 2 and 10, the cap member 12 may be provided with a post and a handle or arms, such as, for example, as shown in connection with the embodiments of FIGS. 2*a*, 8 and 9. In addition, the cap member 12 (and 212, 512) and anode 100 may be integrally provided so that the anode 100 has a cap member 12 (or 212, 512). Optionally, the cap member 12, 212 or 512 may be separately provided, and the anode 100 may secure to the cap member 12 or 212, 512, such as, for example, with mating threads provided on the anode and cap member. According to the invention, the anode may be provided with pins or other element or elements that may be used to facilitate rotating the anode relative to the connector. Although a cap 12, 212, 512 is shown, the cap member may be excluded, and the anode used without the cap, or with elements provided on the anode for facilitating rotation of the anode. Alternately, the means for removably coupling the anode with the means for connecting the device to a structure may comprise a connection mechanism that secures the anode with the connector without the drawbacks associated with threads. According to alternate embodiments, the connector may be constructed with a connecting mechanism that permits ease of connection and disconnection of the anode from the device, and embodiments may be constructed without the spring 24 that closes the valve 15. For example, one preferred alternate embodiment may be provided with a sealing element (e.g., the first sealing element or valve 15, the second sealing element 16, or both) to seal against the anode when the anode is present in the device. According to another embodiment the sealing element is a valve that expands to seal against the anode, and to contract to close the opening when the anode is not present (e.g., is removed or degrades). Alternate embodiments provide a device for rapid disconnect of an anode from a system using the connectors shown and described herein. For example, according to some embodiments, the device may provide for rapid disconnect of the anode, including embodiments where the cross-slit valve is not provided, but where a sealing element is provided (such as, for example, a sealing element like the second sealing element 16) to provide a seal against the anode body when the anode, or anode portion is present to engage the seal. Embodiments of the invention also may provide a rapid disconnect feature for connecting and disconnecting an anode from an anode plug, as illustrated and described herein, but without the sealing elements. A device part may be installed on the system, and another device part may hold the anode and connect to the installed device part. In addition although reference is made to zinc and zinc alloys, the anode may be constructed from other types of metals in alloys with or as a substitute for zinc. Exemplary embodiments are shown and described herein. In addition to the aforementioned, various modifications and changes may occur to those skilled in the art without departing from the spirit and scope of the invention described herein and as defined by the appended claims.

What is claimed is:

1. An anode for use with an anode plug that holds the anode in a structure containing a cooling fluid, said anode comprising: a body made from a conductive material; connecting means for connecting said anode to said anode plug, wherein said connecting means is configured to releasably connect said anode to said anode plug by lowering said anode into said anode plug and to release said anode from said anode plug by lifting said anode from said anode plug, including an indicator means contained within said anode for indicating a wear condition of said anode.

2. The anode of claim 1, wherein said connecting means for connecting said anode to said anode plug comprises a press-fit engagement means for engaging with said anode plug, wherein the plug to which said anode is connected includes a channel, and wherein said anode has a width that is smaller than the width of said channel.

3. The anode of claim 2, wherein the conductive material is selected from the group consisting of conductive metal.

4. The anode of claim 3, wherein said conductive metal is selected from the group consisting of zinc, aluminum and alloys thereof.

5. The anode of claim 2, wherein said press-fit engagement means comprises a groove disposed in said anode.

6. The anode of claim 5, wherein said groove comprises an annular groove.

7. The anode of claim 5, wherein said anode has a ramped surface to facilitate locating the leading to said groove.

8. The anode of claim 5, wherein said groove comprises a first wall that is substantially vertical and at least one or more walls that are slanted in relation to said vertical wall.

9. The anode of claim 6, wherein said anode body has an outer surface, and wherein said annular groove is disposed in said body outer surface.

10. The anode of claim 9, wherein said anode has a cross-section that is substantially cylindrical.

11. The anode of claim 1, wherein said connecting means for connecting said anode to said anode plug comprises an annular groove disposed about said anode.

12. The anode of claim 1, wherein said anode has a channel disposed therein, wherein said indicator means for indicating a wear condition of said anode comprises an indicator disposed within said anode channel that exhibits a discernible response when exposed to water.

13. The anode of claim 12, wherein said indicator comprises a detection pad that exhibits a color change in the presence of water.

14. The anode of claim 12, wherein said channel is enclosed and is bordered by at least a portion of said anode body, and wherein said channel has a window through which said indicator is viewable.

15. The anode of claim 12, wherein said channel has a window through which said indicator is viewable, and wherein said window is located on said anode.

16. The anode of claim 14, wherein said window seals at least one first opening of said channel, and wherein the said at least one portion of said anode body that borders said channel encloses a second opening of said channel, said second opening being closed when said anode body portion is present and being open when said anode body portion is not present to permit fluid communication into said channel.

17. The anode of claim 14, wherein, when said at least a portion of said anode body that borders said channel is eroded, said channel is provided with an opening for communicating with the cooling fluid in said structure.

18. The anode of claim 1, wherein said connecting means for connecting said anode to said anode plug comprises a non-threaded engagement means for engaging with said anode plug, wherein said connecting means is configured to releasably connect said anode to said anode plug by lowering said anode into said anode plug and to release said anode from said anode plug by lifting said anode from said anode plug.

19. The anode of claim 1, further including an anode plug with a top and a bottom, wherein said anode plug has a channel therethrough extending from said top to said bottom.

20. The anode of claim 18, wherein said engagement means comprises pins.

21. The anode of claim 18, wherein said engagement means comprises a groove.

22. The anode of claim 1, wherein said indicator means includes an indicator and wherein said indicator is provided in said anode.

23. An anode for use with an anode plug, said anode having a channel therein and an indicator means for indicating a condition, the indicator means being disposed within said channel, Said channel having a window provided therein, said indicator means being viewable through said window, and wherein said anode is a sacrificial anode with a body that is made from a sacrificial metal, wherein said channel is provided in said anode body, wherein the indicator means is disposed within the channel of the anode body, and wherein the window is provided on the anode body to seal the channel of the anode body.

24. The anode of claim 23, having connecting means for connecting said anode to said anode plug.

25. An anode for use with an anode plug, said anode having a channel therein and an indicator means for indicating a condition, the indicator means being disposed within said channel, said channel having a window provided therein, said indicator means being viewable through said window, wherein said indicator means comprises an indicator located within the channel of the anode body and wherein said indicator is attached to the window.

* * * * *